US006508075B1

(12) United States Patent
Shipley et al.

(10) Patent No.: US 6,508,075 B1
(45) Date of Patent: Jan. 21, 2003

(54) VERTICAL TUBE ICE MAKER

(76) Inventors: Kenneth Ray Shipley, 1207 Hansberry Rd., Memphis, IN (US) 47143; Michael Anthony Passanisi, 9210 Fawnridge Pl., Louisville, KY (US) 40229; Merritt Todd Teague, 708 Alabama Ave., Sellersburg, IN (US) 47172

( * ) Notice: Subject to any disclaimer, the term of this patent is extended or adjusted under 35 U.S.C. 154(b) by 0 days.

(21) Appl. No.: 09/945,999

(22) Filed: Sep. 4, 2001

(51) Int. Cl.[7] ..... F25C 1/12
(52) U.S. Cl. ..... 62/347
(58) Field of Search ..... 62/347, 74

(56) References Cited

U.S. PATENT DOCUMENTS 2,826,045 A * 3/1958 Poffenberger ..... 165/115
2,870,612 A * 1/1959 Garland ..... 62/138
2,997,861 A * 8/1961 Kocher et al. ..... 62/344
4,862,706 A * 9/1989 Yoshida et al. ..... 62/347
5,325,682 A * 7/1994 Chiang ..... 62/320
5,493,872 A * 2/1996 Hibino et al. ..... 239/600

* cited by examiner

*Primary Examiner*—William E. Tapolcal
(74) *Attorney, Agent, or Firm*—Wood, Herron & Evans LLP

(57) ABSTRACT

An improved vertical tube ice maker has an integral common water manifold providing water for ice making to a plurality of vertical ice-making tubes. A cutter bar beneath the tubes is removable for servicing in a direction perpendicular to its axis. A water tray and ice chute beneath the tubes is an integrally molded element, serving as a base for the ice maker cabinet of structural insulated panels.

13 Claims, 5 Drawing Sheets

VERTICAL TUBE ICE MAKER

BACKGROUND OF THE INVENTION

This invention relates to ice making and more particularly to vertical tube ice makers and improvements thereon.

Vertical tube apparatus for making ice is well known. An inside cylinder of sheet metal is disposed internally of an outer cylinder of sheet metal forming a hollow-walled tube where the inner surface is defined by the inside cylinder and the outer surface is defined by the outer cylinder. Coolant is circulated within the annular space between the two cylinders. Water is dispersed onto both the inner surface of the inner cylinder and onto the outer surface of the outer cylinder where it is frozen to form sheet ice in cylindrical or tube-shaped form on both outer and inner surfaces. When desired, the coolant is heated to allow slight melting and the cylindrical inner and outer ice sheets slough away from the respective tube surfaces and fall onto a cutter, where the ice is broken, then collected for use. In usual fashion, ice makers are made with a plurality of adjacent parallel vertical tubes of this type to facilitate making volumes of ice required in facilities where such volumes are required.

Current vertical tube ice makers, while producing ice, have several inherent disadvantages which produce significant manufacturing, assembling and operational difficulties. Certain of these result from the need to provide separate systems to deliver water, on one hand, and coolant or warming gases or fluids on the other hand, to confined spaces at the tops of the tubes. For example, in the water delivery system alone, the water dispensing devices typically compromise conduits in annular donut-like shapes surrounding the outer surface of the ice making tube, and other water conduits disposed inside the ice making tube. Water is sprayed onto the inner and outer tube surfaces from outlets or orifices in these respective conduits. These conduits are typically made of copper and use copper fittings. Fitting up these conduits and fittings is labor intensive, they are hard to install, are prone to clogging and scale buildup from water flowing therethrough, and are very hard to replace. Moreover, they must be configured to avoid interference and be oriented around the components of the cooling media delivery systems.

It is thus one objective of the invention to provide an improved apparatus for dispersing water onto the ice forming surfaces of vertical, ice making tubes.

A further objective has been to provide improved water handling apparatus in an ice maker, eliminate clogging and scale buildup and facilitate manufacture, assembly and replacement of water handling apparatus in an ice maker.

Once ice sheets are formed on the tube, the coolant is heated so the tube surfaces warm and ice sheets gravitate or slough off down the tube into a cutter for comminution and collection as smaller ice chunks, particles, blocks or other shapes. In the past, the cutters are driven from one end of the apparatus with open belts and pulleys. The drive end extended through an opening in the side of the machine, usually via an access plate, through which the cutter was inserted lengthwise, i.e. in an axial direction. Removal for replacement, sharpening or the like required substantial service clearance beside the machine, for a distance at least as long as the cutter so it could be withdrawn from the side and replaced. This all made for cumbersome handling, at best, and dangerous or practically impossible servicing at worst.

It has thus been a further objective of this invention to provide an improved cutter drive for an ice maker which eliminates open drive components, eliminates the need for significant machine side service clearance, and provides machine-front service access for cutter removal.

In yet another aspect of ice makers, it has been the practice to form an underlying water tank and an ice chute from sheets of stainless steel, and then insulate with one of many forms of insulation. This increases assembly difficulty and expense. Also, the cracks and corners inherent in many such water tanks can lead to more unsanitary conditions.

It has thus been a further objective of the invention to provide an improved water tank and ice chute, and to improve the insulating qualities and techniques of typically prior machines.

In a further aspect of the invention, it has been known that steel framing is used to build a cabinet frame for an ice maker to hold the water tank, evaporator housing and other features of the machine. Such a frame is then completed with sheet metal or other flat panels and insulated. This construction, too, is labor intensive.

It has thus been a further objective of the invention to provide an improved ice maker, while eliminating the need for separate frame, side panels and insulation.

SUMMARY OF THE INVENTION

To these ends, the invention contemplates an improved ice maker having a number of unique features. A single unitary, preferably roto-molded, plastic water manifold is provided for servicing a plurality of vertical ice making tubes.

The manifold is configured to permit connection of the coolant feed and recirculation conduits to the ice-making tubes. At the same time, the manifold is provided with a number of outwardly extending integral projections directed toward the tubes and provided with orifices for disbursing water onto the tube surfaces in appropriate direction and volume for the sheeting action suited to ice formation. Preferably, one integral projection of the manifold extends into the upper end of each tube and is provided with orifices directed for spraying water onto the internal surface of the tube. Other manifold-integral projections extend along the top end of, and outside each tube and have an orifice so that a plurality of these projections are disposed to spray water onto the outer surface of at least one tube. Several intermediate projections disposed in areas between the tubes have multiple orifices to spray water onto the outer surface of two adjacent tubes.

This single manifold has a water inlet fitting which receives a single water supply hose, secured by a hose clamp, for supplying the entire manifold with enough water for each tube in the ice maker. There are no copper water conduits associated with each tube, nor any soldering in assembly, or for repair.

Scale does not tend to build on the plastic surfaces of the manifold and clogging is significantly reduced, if not wholly eliminated. Access to the top of all the tubes for any repair, servicing of the coolant connections or the like is accomplished by removal of a single manifold, as compared to the numerous spaghetti-like structures of the prior, copper conduit served water supply. Manufacturing and assembling costs are substantially reduced and maintenance is facilitated.

The ice maker has a cutter bar which is accessible, serviceable and removable from the front, rather than the side, of the ice maker. That is, the cutter bar is removed forwardly, directly away from the area beneath all tubes at substantially the same time and not pulled from the side where it moves in an axial or endwise direction beneath each tube, one at a time.

A gear motor is disposed within the ice maker. One end of the cutter is a permanent sealed bearing mounted on an internal panel, the other is mounted in the gear motor without a second, extraneous bearing being necessary. A slotted opening allows direct forward withdrawal of the drive from the gear motor end so the entire cutter bar and drive can be serviced or removed directly from the front of the ice maker, yet is enclosed in the cabinet where access during operation is limited.

In another feature of the invention, the water tray and ice chute is formed of roto-molded plastic as one part, which also serves as the base of the ice maker. The water tray/ice chute is constructed as a double walled tank, with the air space created by the double walls eliminating any need for further base insulations. There are no cracks or sharp corners caused by any weld to harbor unsafe organisms, and its plastic nature also resists scale buildup.

In a further feature of the invention, the integral water tank and ice chute described above is configured and used as the base of the ice maker. No frame is used for its housing or cabinet. Instead, structural insulated panels are secured to the base to form the housing. Such panels comprise a foam insulative core bonded to inner and outer steel skins. This construction produces a very strong cabinet, frameless, and eliminates the need for separate frame, panels and insulation.

These and other objectives and advantages will become readily apparent from the following detailed description of a written embodiment of the invention and from the drawings, in which:

DETAILED DESCRIPTION OF THE DRAWINGS

DETAILED DESCRIPTION OF THE INVENTION

Figure 1:
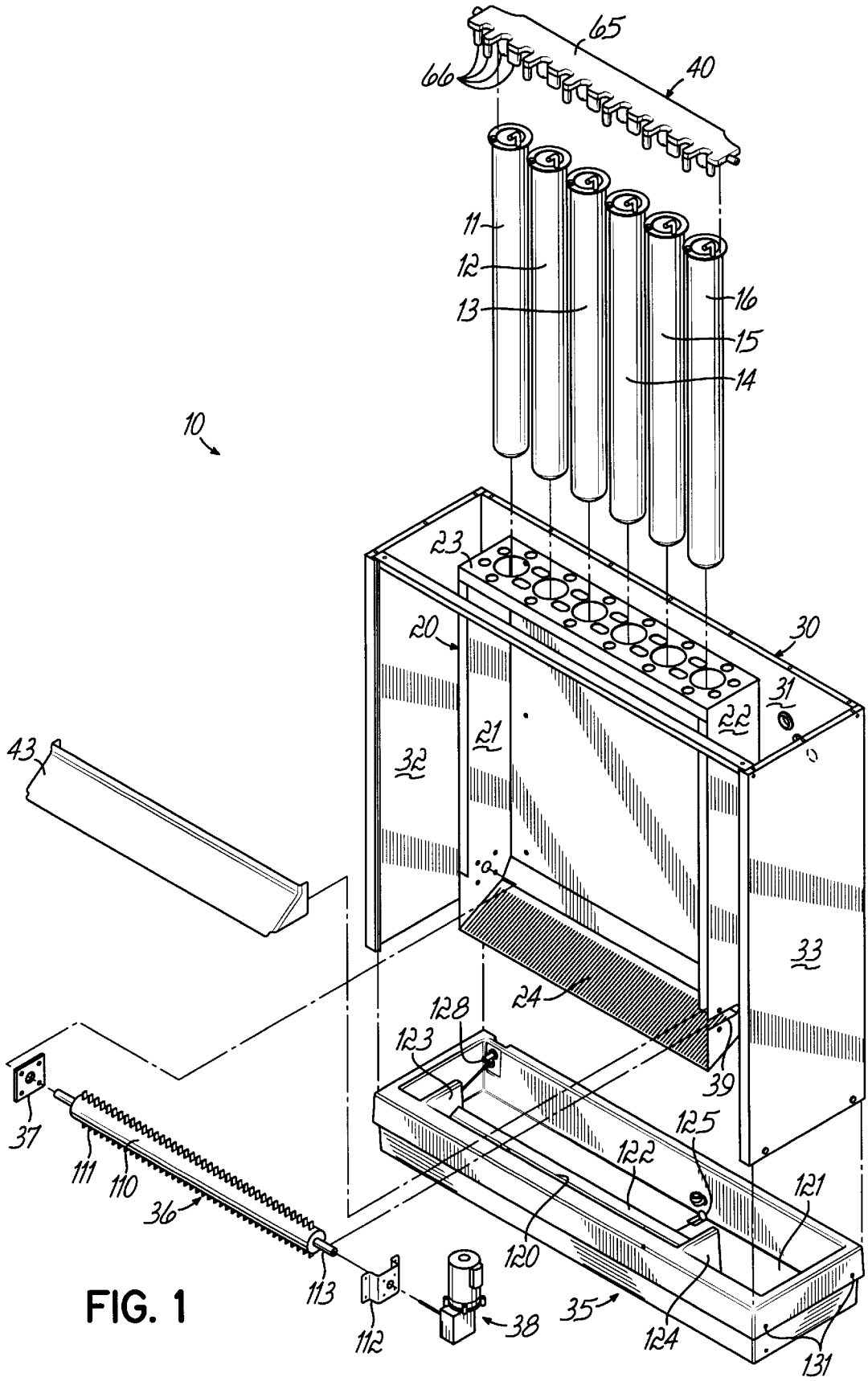
FIG. 1 is an exploded view of an ice maker and components thereof according to the invention.

Turning now to the drawings, FIG. 1 depicts various components of a vertical tube ice maker 10. Ice maker 10 includes a plurality of six ice making tubes 11–16. While these are preferably vertical, the term "vertical tube" ice maker as used herein refers to upstanding ice-making tubes whether actually vertical or inclined at some angle. While six tubes are shown in this embodiment, the number of tubes could be one or more. Various aspects of the invention, discussed below, become even more useful with an increase in the number of tubes above one. Ice maker 10 further includes a frame 20 having at least two side members 21, 22, top member 23, and grill member 24.

Frame 20 is disposed and mounted in a cabinet 30 comprising, in part, a back wall 31, and side walls, 32, 33. The walls 31–33 (together with a front wall 34 as seen in FIG. 7) are fastened together and mounted on base 35 as will be described.

Figure 7:
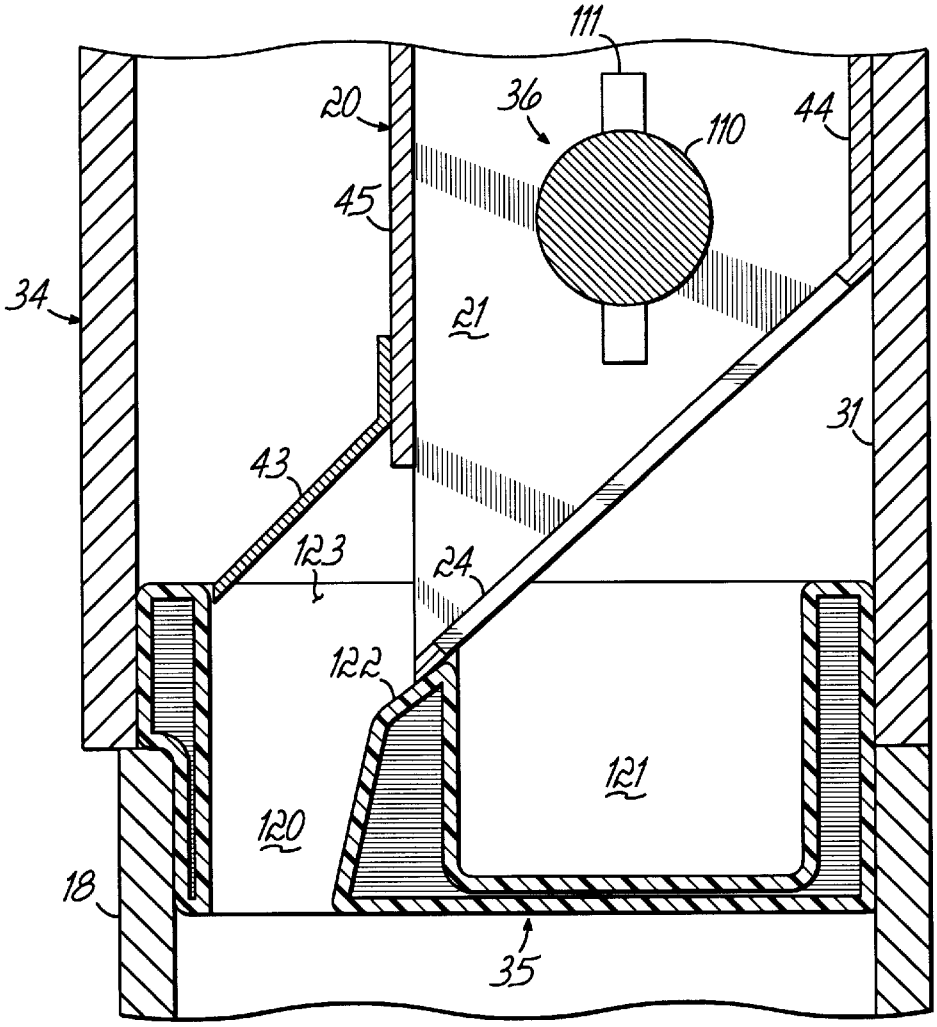
FIG. 7 is a cross-sectional view taken along lines 7—7 of FIG. 2 and showing portions of the cabinet, panels and base of the invention for illustration.

Preferably, base 35 is adapted to be disposed over an insulated bin ice chest, ice compartment or other ice receptacle 18 (FIG. 7). These receive broken ice from the cutter through a chute in the base as will be described.

A top wall, not shown for clarity, is preferably connected across the top edges of the walls 31–34 and the front wall.

Rotary ice cutter 36 is mounted at one end in a removable, flange-mounted bearing shown diagrammatically at 37, and at another end in a rotary drive such as a gear motor 38. Bearing 37 is adapted to removably mount on wall 21 of frame 20 while gear motor 38 is adapted for mounting on wall 22 of frame 20 via slot 39.

A header 40 is operably mounted at an upper end of tubes 11–16 for distribution of ice making water to the tubes 11–16 as will be described.

Finally, guard cover 43 is operably and removably disposed adjacent grill 24 in such a way as to allow ice, and water, to fall onto the grill, then through chute 120 in base 35 as will be described.

These components are illustrated in assembled condition in FIGS. 2 and 7, together with additional components as will be described.

Figure 5:
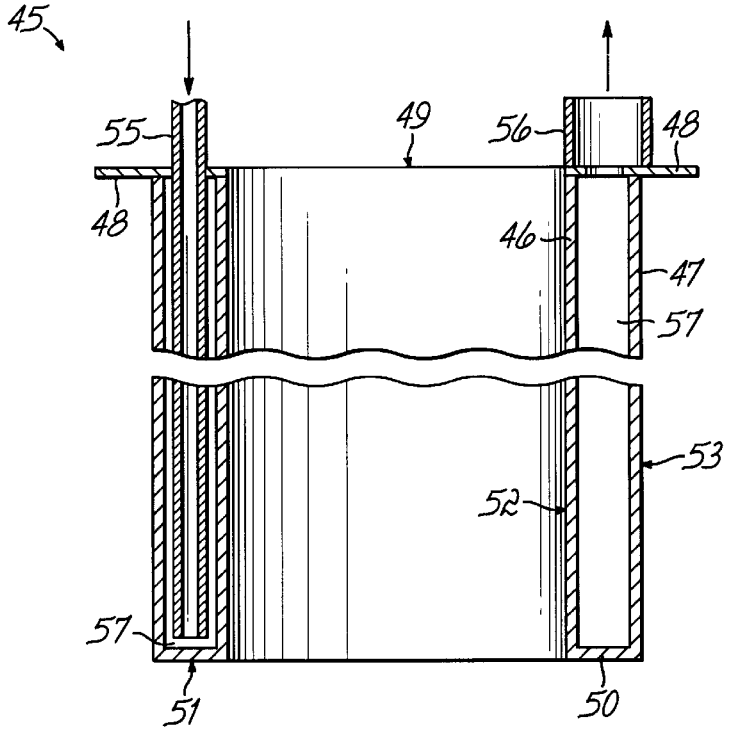
FIG. 5 is a cross-sectional, partially broken view of one ice-making tube.
Figure 6:
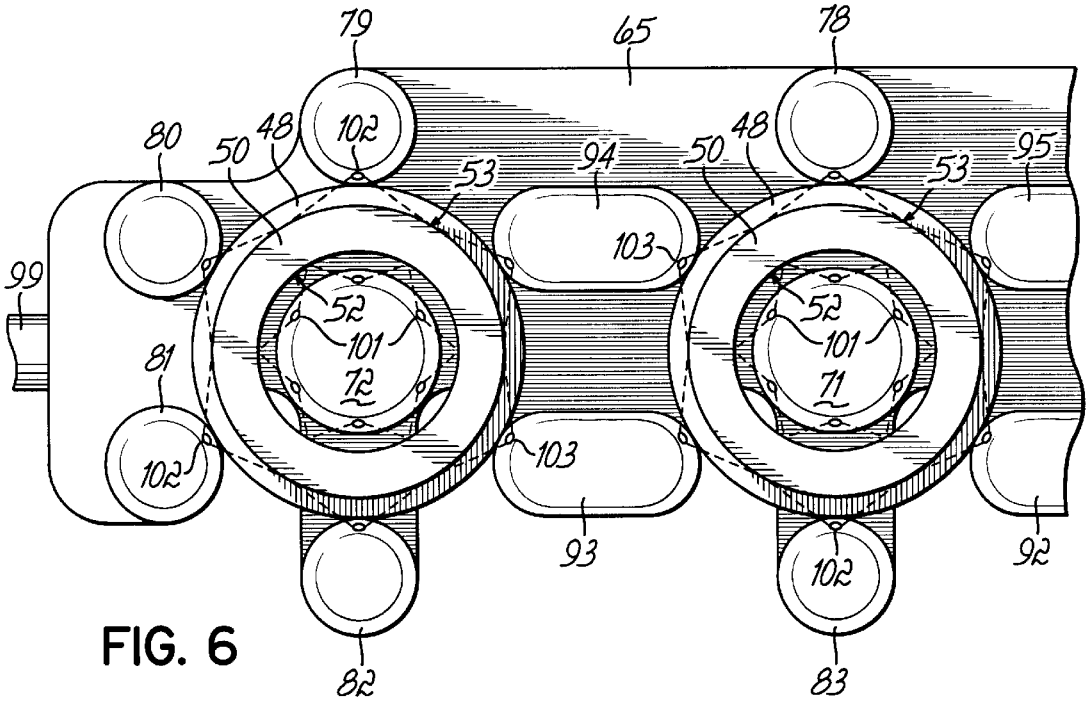
FIG. 6 is an illustrative, upwardly directed view illustrating the spray patterns of water dispensing from the selected projections onto the ice-making tubes.

Turning briefly to FIG. 5, a single typical ice making tube 45 is described. Illustrative tube 45, and all tubes 11–16 are essentially alike. Each is a double-walled tube comprised of an inner cylinder 46 and an outer cylinder 47 having radially extending annulus 48 covering the radial space between the two cylinders at the upper end 49 of the tube. A similar plate 50 seals the radial space between cylinders 46–47 at the lower tube end 51. Thus, cylinder 46 defines an interior ice making surface 52 while cylinder 47 defines an exterior ice making surface 53.

Preferably, a coolant inlet conduit 55 extends through plate 48 at top end 49 of each tube downwardly proximate lower end 1 in space 57. A coolant outlet conduit 56 is connected to space 57 at the upper end 51 of the tube through plate 48. Accordingly, each tube 11–16 includes a coolant inlet 55 and an outlet 56.

In any event, coolant can be pumped through inlet 55 into space 57 between the cylinders 46, 47, and out from outlet conduit 56 to cool surfaces 52, 53 so water thereon freezes into ice. The ice making cycle includes reversing the evaporative cooling process so that warm coolant media is cycled through the tubes 11–16 to cause the formed sleeves of ice on the surfaces 52, 53 partially melt and slough off or fall from surfaces 52, 53 downwardly onto grill 24.

Multiple tubes 11–16 are so constructed and function as described with respect to tube 45.

It will be appreciated that coolant is supplied to inlets 55 by a coolant delivery manifold 61a through any suitable valves 63, such as thermostatic expansion valves, while the coolant outlet conduits 56 are connected to a coolant outlet manifold 61. Moreover, warmed compressive discharge gas from the cooling process is alternately run through inlets 55 via conduit 60 and any suitable valving 64 such as thaw gas solenoid valves, all as illustrated in FIG. 2.

It will be further appreciated that in multiple tube ice making devices, the plumbing required for coolant alone requires quite a bit of space and is disposed over the tubes 11–16, restricting access thereto, and interfering with other components over the areas covered by the plumbing.

Figure 2:
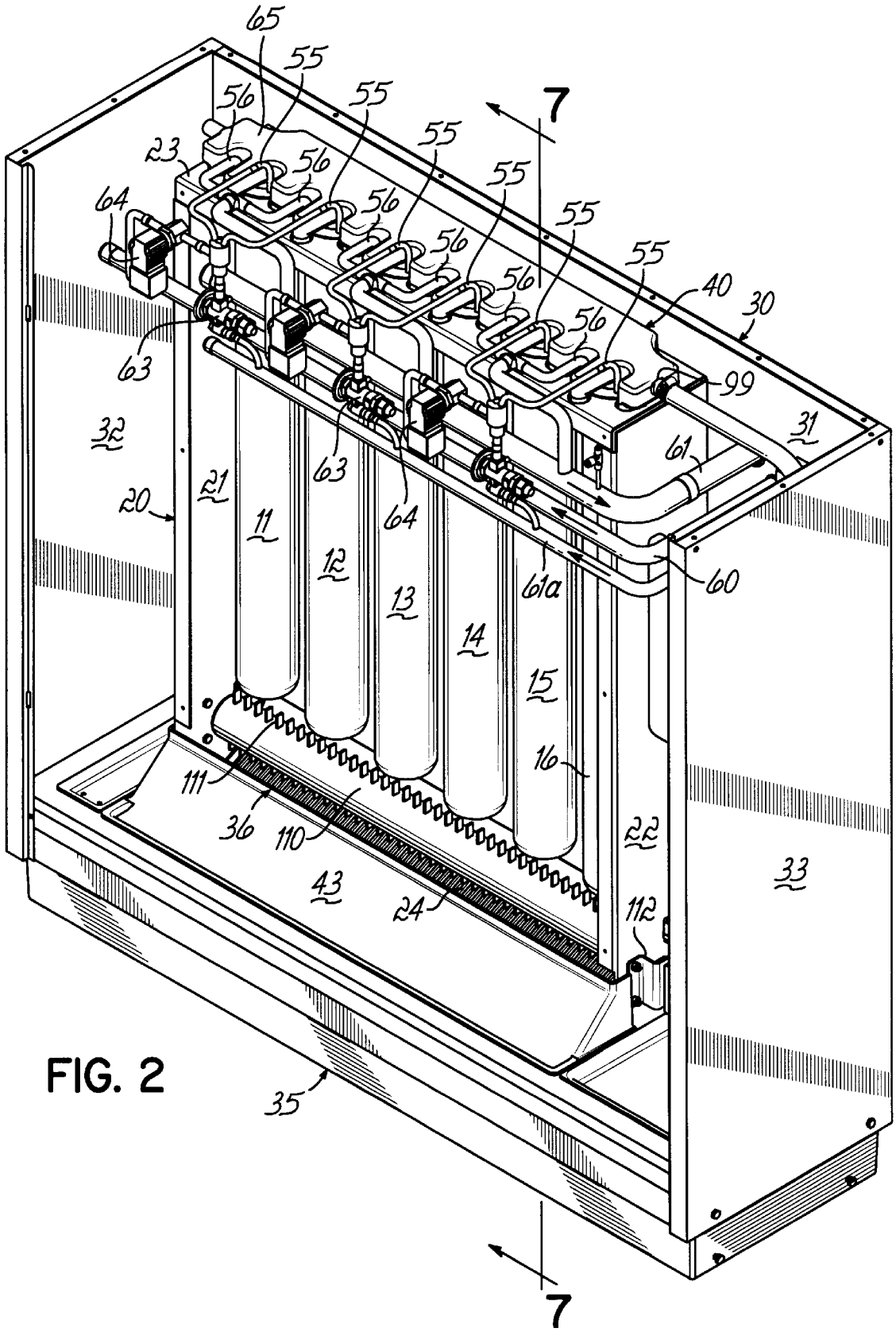
FIG. 2 is an isometric view of an ice maker according to the invention and showing the components of FIG. 1 in assembled condition with several additional features shown in detail.
Figure 3A:
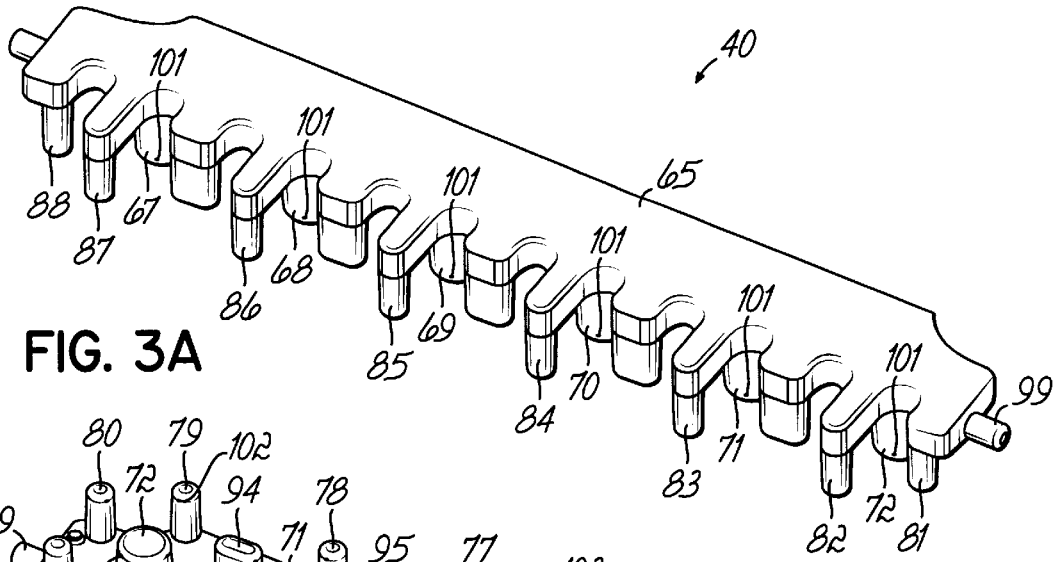
FIG. 3A is an isometric view of the top area of the header according to the invention.
Figure 3B:
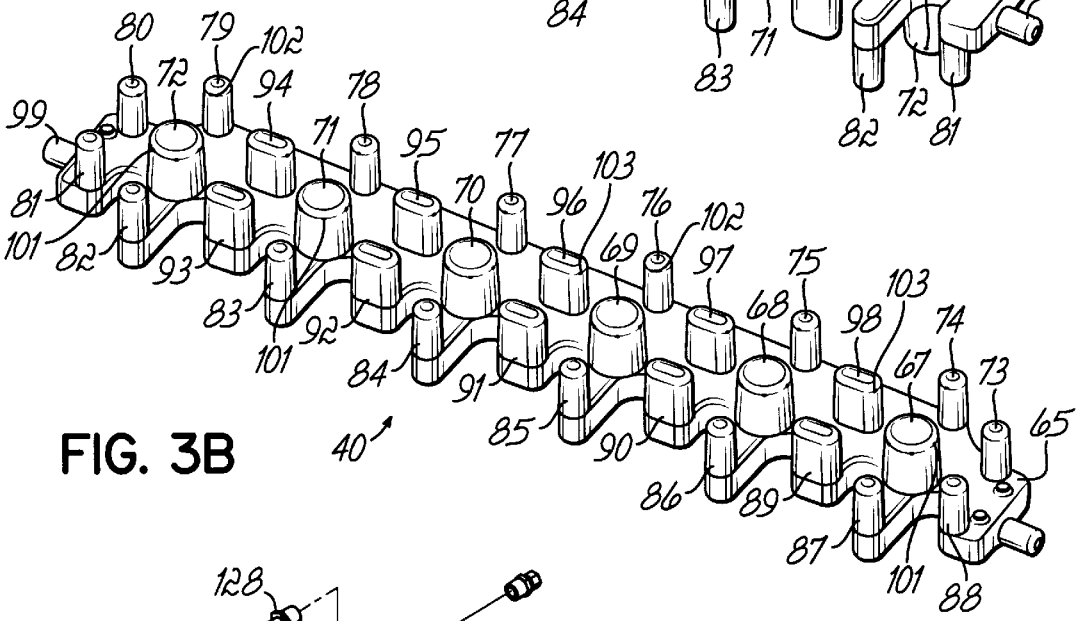
FIG. 3B is an isometric view of the bottom area of the header of FIG. 3A.

Referring to FIGS. 2, 3A and 3B, the preferred header 40 for ice maker 10, according to the invention, is described. Header 40 preferably comprises a single, integral molded component comprising a common water manifold 65 and a plurality of integral water delivery projections 66 (FIG. 1). The header 40 is best seen in FIGS. 3A and 3B.

Selected projections 67–72 are seen in FIG. 3B. Another set of selected projections 73–88 is also shown in FIG. 3B as is a third set of selected projections 89–98. Projections 67–72 are molded to conform to positions where they extend downwardly into the upper ends 49 of tubes 11–16, when header 40 is mounted in place. Projections 73–88 extend downwardly into positions adjacent respective tubes 11–16 and projections 89–98 extend downward into positions adjacent and somewhat between respective ones of tubes 11–16.

Projections 67–72 each have a plurality of orifices 101 spaced about their lower ends and directed toward interior surface 52 of cylinder 46. When water is supplied to manifold 65 via a water inlet 99 (FIG. 2), water exits orifices 101 and coats surface 52. Water inlet 99 is drilled at a size to control the overall inflow of water to satisfy the water flow needed for spraying onto the tubes to form ice. The size of the inlet 99 can be varied to accommodate ice makers of varied outputs and size.

Projections 73–88 each have at least one orifice 102 at their lower ends and directed toward outer surface 53 of cylinder 47 for dispensing water thereon. Projections 89–98 each have at least two orifices 103 also at their lower ends and directed toward surface 53 of cylinder 47 for dispensing water thereon.

It will be appreciated that this orientation of orifices is preferably sufficient to dispense water onto the entire inner and outer surfaces 52 and 53 so ice can be formed thereon in relatively even sheets or layers.

Thus, selected projections 73–88 have single orifices, while selected projections 67–72 have preferably 3 to 6 or more orifices 101 spaced therearound and selected projections 89–98 have preferably two orifices 103 for direction of water onto two adjacent tubes.

In this manner, a single unitary manifold and projection from a single header which is easily assembled over an assembly of tubes 11–16 for supplying all water thereto. The normal plumbing required for these multiple orifices or spray outlets in other systems is eliminated. Such plumbing, conduits and fittings were very difficult to assemble and manufacture. Usually of copper, they tend to clog and require repair. Moreover, if a tube or coolant plumbing had to be repaired in an old vertical tube system, removal of interfering plumbing was time consuming and costly, simply for access to the parts needing repair.

Use of an integral manifold of plastic eliminates such clogging, joint leaks and the like. Its application is not time or labor intensive, and a variety of wetting application volumes and spray patterns are readily available by molding, drilling or otherwise forming the orifices as desired.

Turning now to the cutter 36, it will be appreciated that the cutter 36 comprises a bar 110 having a plurality of suitably shaped cutting blades 111 thereon (FIG. 2). The cutter extends between sidewalls 21, 22 of frame 20, mounted at one distal end in a suitable bearing 37, such as a flange-mounted bearing, which is secured to side 21, and at a drive end to gear motor 38 removably mounted via bracket 112 (FIG. 1) on side 22 of frame 20. Slot 39 accommodates insertion of the cutter drive shaft 113 (FIG. 1) into position on the frame 20 for operative connection to gear motor 38. With this construction, it will be appreciated that the entire cutter 36 and drive 38 can be removed, for maintenance or repair, in a direction parallel to the planes of sides 21, 22 (i.e. perpendicular to the rotary axis of the cutter). It is not necessary to remove cutter 36 in a direction parallel to its axis of rotation. This results in use of the ice maker in locations without requiring excessive space at its side to accommodate cutter removal. The ice maker 10 can thus be disposed in relatively more confined spaces as wide as the cutter 36 is long.

It will be further appreciated that cutter 36 is oriented operably beneath the lower ends 51 of the tubes 11–16. Those ends are disposed over grill 24, such that ice dropping from the tubes falls onto the grid 24. As a cutter 36 rotates, the ice is broken up by the action of the cutter blades 111 compressing the ice against the grill 24.

When the ice is broken up, it slides along the grill into an ice chute 120 in base 35 as will be described. Any water, such as overflow not frozen on the tubes 11–16 also falls onto grill 24. It passes through the grill into a water receptacle 121 in base 35 as will be described.

Figure 4:
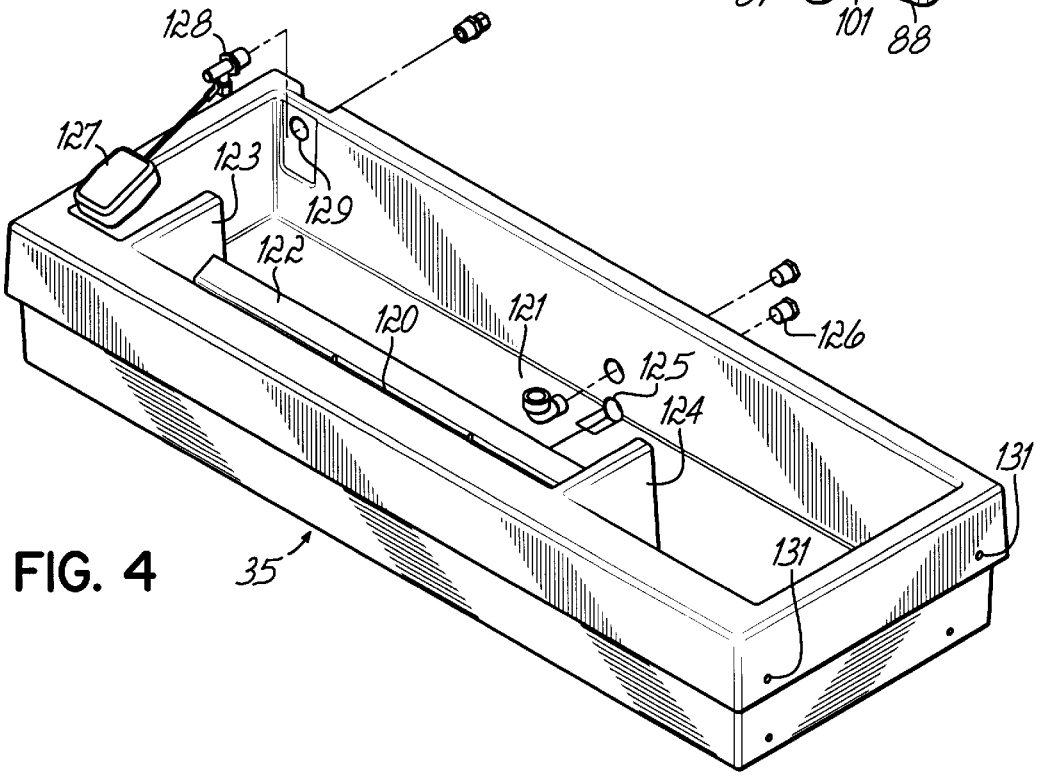
FIG. 4 is an isometric view of the water and ice receiving tray of the invention.

Referring to FIGS. 1, 2 and 4 in particular, it will be appreciated that base 35 is preferably an integral, single piece molding of any suitable plastic material. Base 35 is preferably molded with hollow walls for insulating the base and providing structural rigidity. Particularly, space between the walls serves to thermally insulate the base. Alternately, foam or other substances can be used in that space to enhance the insulative quality of the base.

Base 35 defines an ice chute 120 and a water receptacle 121. Ice chute 120 also is provided with a tapered lip 122 for disposition adjacent a lower end of grill 24 to receive broken ice from the grill and direct it into chute 120. Chute 120 is defined, in part, by end walls 123, 124, which are preferably integral parts of base 35, molded therewith. When the base 35 is disposed over an ice receiving bin 18, the ice falls through chute 120 into the bin.

Base 35 is provided with drain outlet 125 and plug 126. A float 127 is disposed at one end of water receptacle 121 and operates a water level indicating switch 128 to provide a signal when water in receptacle 121 rises to a predetermined level so water flow can be reduced, the freezing process accelerated, and the receptacle drained as required. Switch 128 can be mounted in opening 129 of base 35 with appropriate seals and fittings.

Finally, base 35 is provided with means to secure cabinet 30 thereon, such as holes 131.

Referring now to FIGS. 1 and 2, it will be appreciated that cabinet 30 is defined by at least three walls, including back wall 31 and side walls 32, 33. In use, the cabinet front, between walls 32, 33, will be covered by a removable front panel 34 (FIG. 7).

In the past, ice maker cabinets have been formed with cabinet frames, surface skins forming the walls, and an insulation interior of the skins to insulate the cabinet. According to this invention, no such frame is used. Instead, the cabinet is formed of structural insulated walls 31–34, as shown (and a top panel, not shown, for clarity) secured together at adjoining edges and providing their own support. Such insulated walls or panels are known in the building industry as "SIP" panels or "Structural Insulated Panels."

They comprise a solid foam insulating core bonded to inner and outer steel skins. They provide a very strong cabinet, eliminating the need for separate frame, side panels and insulation.

Moreover, it will be appreciated that the walls 31–34 are disposed directly on base 35, secured thereto with screws or any other suitable fastener forming with base 35 (and front and top removable panels) a structurally strong, insulated cabinet 30 for housing the ice making components. Walls 31–34 can be screwed or adhered onto base 35, or base 35 could be molded with cooperating surfaces for receiving and holding bottom edges of walls 31–34.

Also, it will be appreciated that frame 20, including a back panel 44, for holding the ice forming tubes 11–16 is secured by any suitable means to rear wall 31 of cabinet 30 and is supported thereby (FIG. 7). A panel 45 (FIG. 7) preferably of sheet metal, is secured to frame 20 in front of the tubes.

Accordingly, it will be appreciated that the invention provides an ice maker which is easily assembled and serviced, with extended life due to reduction in clogging of the water supply, and with facilitated cutter access and removal for maintenance.

These and other modifications and advantages will become readily apparent to those of ordinary skill in the art without departing from the scope of this invention and the applicant intends to be bound only by the claims appended hereto.

What is claimed is:

1. In apparatus for making ice, including a plurality of ice-making tubes, said tubes comprising respective exterior and interior ice making surface;

a header for distributing ice-making water to both said respective surfaces of said tubes, said header comprising:

a common manifold;

an ice-making water inlet to said manifold;

a plurality of projections extending from said manifold alongside respective tubes, some of said plurality of projections extending alongside interior ice making surfaces of said tubes and others of said plurality of projections extending along exterior ice making surfaces of said tubes, said projections defining water spray orifices for directing water therefrom onto respective ones of said interior and exterior ice making surfaces of said tubes;

said projections being operably connected, with said common manifold, for water flow therethrough, and comprising an integral part of said manifold, such that ice making water is distributed on both exterior and interior surfaces of said tubes.

2. In the apparatus of claim 1, a header wherein said manifold and said projections comprise a one-piece molded header.

3. In the apparatus of claim 2 wherein each projection for directing water has at least one orifice and wherein selected projections have at least two orifices, each directed at the exterior ice making surface of a different ice-making tube.

4. In the apparatus of claim 2 wherein a selected number of said projections extend to positions interior of respective tubes and another selected number of projections extend to positions exterior of respective tubes.

5. In the apparatus of claim 4 wherein said orifices are located proximate ends of said projections.

6. In the apparatus of claim 1, each projection having one of said orifices operably communicating with said common manifold.

7. A water distributing header for an ice making machine having ice making tubes therein, said tubes having both exterior and interior cylindrical ice making surfaces onto which ice making water is sprayed for ice making, said header comprising a unitary manifold having a plurality of integral projections extending therefrom, said projections having distal ends and selected projections each having at least one orifice proximate said distal end for dispensing water onto one of the exterior and interior surfaces of at least one of said ice making tube, said projection extending perpendicularly from said header in parallel direction with respect to and alongside said surfaces of said tubes.

8. A header as in claim 7 wherein said manifold and said projections comprise a single, integral molded element.

9. A header for a tube ice maker wherein at least one tube comprises both interior and exterior ice making surfaces, said header comprising a common manifold and a plurality of projections extending therefrom, at least one projection being disposed proximate an interior ice making surface of said at least one tube and another projection being disposed proximate an exterior ice making surface of said at least one tube, and ice making water orifices in each of said projections for distributing ice making water from said common manifold onto both said exterior and interior ice making surfaces.

10. A header as in claim 9 for a tube ice maker wherein said one tube comprises an annular space between said exterior and interior ice making surface and said header further including one projection extending into said at least one tube for distributing ice making water onto an interior ice making surface thereof, and said header further including a plurality of projections disposed proximately said exterior ice making surface of said at least one tube for distributing ice making water onto said exterior ice making surface thereof.

11. A header as in claim 10 wherein at least one of said plurality of projections contains a plurality of ice making water orifices, at least some of which are disposed to direct ice making water onto an exterior surface of another ice making tube than said at least one ice making tube.

12. A header as in claim 9 wherein said tube has an annular space between said interior and exterior ice making surfaces for ice making coolant circulation and including coolant conduits oriented at the upper ends of said tubes for conducting coolant to said annular space, said common manifold being removable from operative position with respect to said tube independently of said coolant conduits.

13. A header as in claim 12 wherein said manifold has a plurality of extensions along an edge thereof, with projections for ice making water distribution disposed at outer ends of said extensions, at least one of said projections on an extension disposed for distribution of ice making water to an exterior ice making surface of said at least one tube.

* * * * *